US006761282B1

(12) United States Patent
Anderson

(10) Patent No.: US 6,761,282 B1
(45) Date of Patent: Jul. 13, 2004

(54) SEALABLE CONTAINER WITH CARRYING HANDLE

(76) Inventor: Dennis C. Anderson, 6475 Chester Ave., Northfield, MN (US) 55057

( * ) Notice: Subject to any disclaimer, the term of this patent is extended or adjusted under 35 U.S.C. 154(b) by 0 days.

(21) Appl. No.: 10/456,063

(22) Filed: Jun. 9, 2003

(51) Int. Cl.[7] ..... B68D 23/10
(52) U.S. Cl. ..... 220/754; 220/771
(58) Field of Search ..... 220/754, 771, 220/657, 659

(56) References Cited

U.S. PATENT DOCUMENTS

| | | | | |
|---|---|---|---|---|
| 2,844,244 A | | 7/1958 | Hanson | |
| 3,499,529 A | | 3/1970 | Kanter | |
| 3,627,113 A | | 12/1971 | DiIoia | |
| 3,737,069 A | * | 6/1973 | Owen | 220/754 |
| 4,989,744 A | | 2/1991 | Tominaga | |
| 5,215,210 A | * | 6/1993 | Ostrum et al. | 220/754 |
| 5,520,306 A | * | 5/1996 | Umiker | 220/754 |
| 6,349,847 B1 | * | 2/2002 | Mangla et al. | 220/754 |

* cited by examiner

*Primary Examiner*—Joseph Man-Fu Moy
(74) *Attorney, Agent, or Firm*—James V. Harmon

(57) ABSTRACT

The invention provides a plastic container that comprises the container body with an integral handle and lid. The container body has a sidewall which terminates in an upwardly facing rim defining a surface to which a sealing member such as a sheet of plastic or aluminum foil can be adhesively bonded. A pair of hinge supports are integrally molded with the container body and each has an upper hinge end which is in alignment with the rim of the container. The handle has a central hand grip portion and a pair of legs each of which is hinged to the hinge support and molded integrally therewith. A pair of hinges defined by plastic ligaments of reduced thickness are both aligned with the top of the rim between one of the supports and the legs of the handle. A beveled side wall is provided at the upper end of each of the hinge supports to define upper support portions of reduced thickness proximate the hinges for allowing unobstructed pivotal movement of the handle about the hinges in each direction until the hand grip contacts the container body thereby eliminating stress on the hinge.

12 Claims, 5 Drawing Sheets

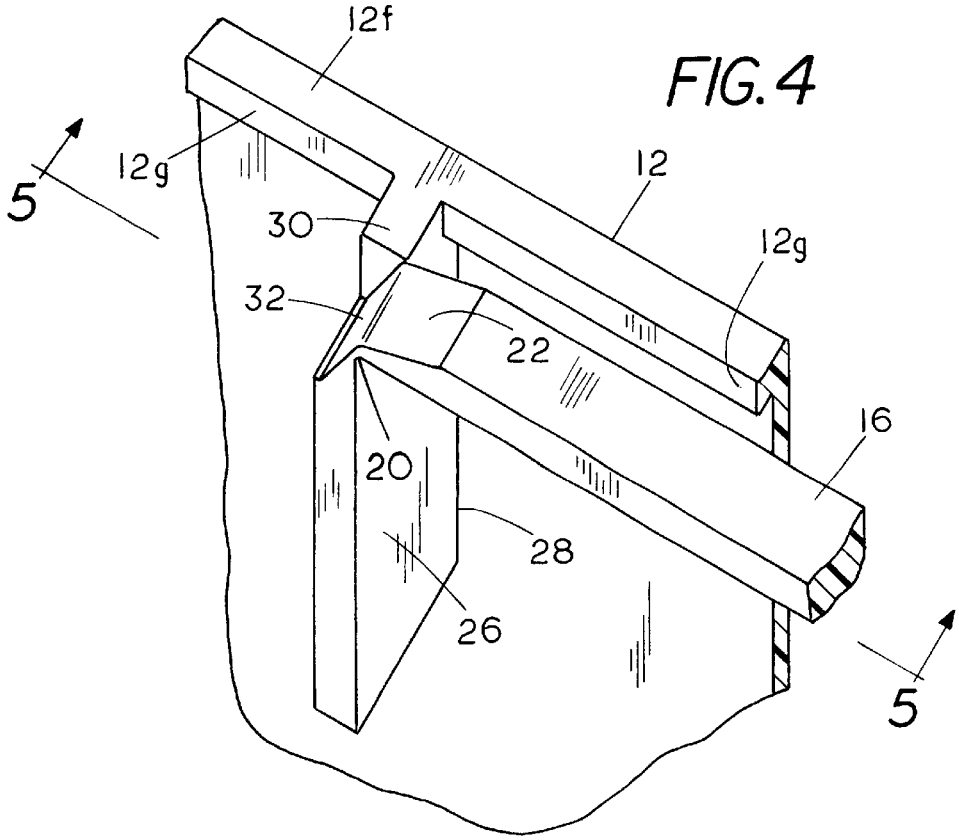
FIG. 4
FIG. 5
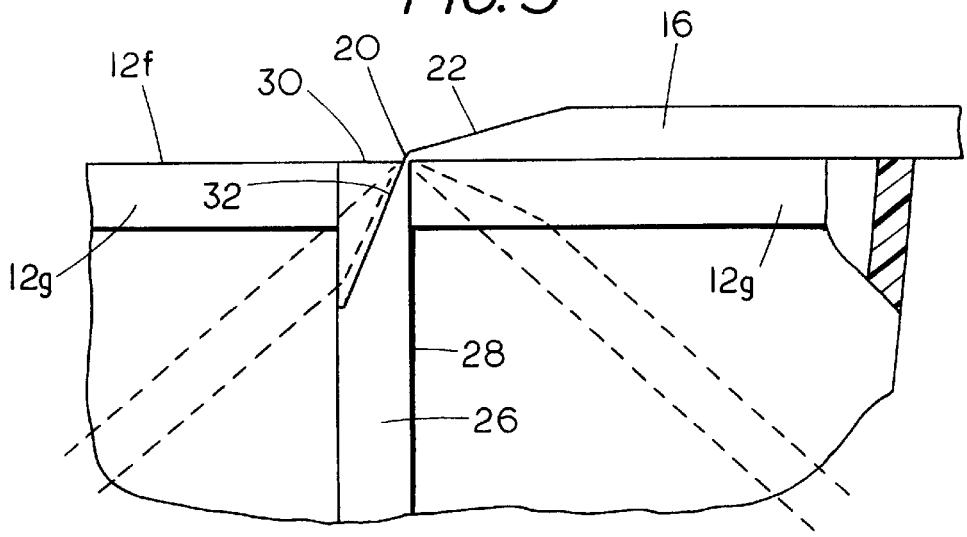

SEALABLE CONTAINER WITH CARRYING HANDLE

FIELD OF THE INVENTION

This invention relates to containers and more particularly to plastic containers that include a carrying handle and lid.

BACKGROUND OF THE INVENTION

Plastic containers have been previously proposed which include a container body having an integral lid and carrying handle such as that described in U.S. Pat. No. 4,989,744. In contrast to the patent, it is an important objective of the present invention to make it possible to seal the container so that it can be used with a variety of food products especially refrigerated food products such as snacks, casseroles, fast foods, refrigerated meals, dairy products e.g. yogurt, butter, cream cheese, prepared pudding and the like. In the patented construction there is no provision for sealing the container and even if an attempt were made to do so, locking projections at the top of the container body would interfere with the bonding of a seal to the top of the container. The present applicant also discovered that any feature around the handle hinges which interferes with the motion of the handle can place stress on the hinges causing them to break prematurely. This can occur in the patented construction since there is a locking provision close to the hinge for holding the handle in an upright position. Thus one objective of the invention is to find a way of preventing stresses from being placed on the hinges while the container is in storage as well as while it is being carried.

Another shortcoming of the patented container is the requirement for a complicated mold due especially to the construction and position of the hinges. It is well known that molding costs are substantially reduced if a two part mold can be used consisting of male and female dies. However, if additional mold components are required, such as a segmented female die or laterally moveable die elements, the molds are not only more expensive but may be more prone to deterioration caused by wear and have other shortcomings. Accordingly it is a further objective of the invention to be able to mold a container of the type described with a simple two part mold consisting of a cooperating male and female die portions confronting one another.

In view of these shortcomings in prior art it is one object of the present invention to provide the container of the type described that lends itself to being sealed by means of a flexible sheet bonded to an upper surface thereof.

Another object of the invention is to find a way of preventing stress from being placed on the handle hinges during use or in storage.

Yet another object of the invention is to provide a plastic container in which the container body, lid and hinge for the handle are constructed in such a way that the container can be molded with the two part mold consisting of a cooperating male and female mold halves confronting one another.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a plastic container that comprises the container body with an integral handle and lid. The container body has a sidewall which terminates in an upwardly facing rim defining a surface to which a sealing member such as a sheet of plastic or aluminum foil can be adhesively bonded. A pair of hinge supports are integrally molded with the container body and each has an upper hinge end which is in alignment with the rim of the container. The handle has a central hand grip portion and a pair of legs each of which is hinged to the hinge support and molded integrally therewith. A pair of hinges defined by plastic ligaments of reduced thickness are both aligned with the top of the rim between one of the supports and the legs of the handle. A beveled side wall is provided at the upper end of each of the hinge supports to define upper support portions of reduced thickness proximate the hinges for allowing unobstructed pivotal movement of the handle about the hinges in each direction until the hand grip contacts the container body thereby eliminating stress on the hinge.

THE FIGURES

FIG. 4 is a perspective view of the hinge area of the container on an enlarged scale.

FIG. 5 is an end elevational view taken on line 5—5 of FIG. 4.

DETAILED DESCRIPTION OF THE INVENTION

Figure 1:
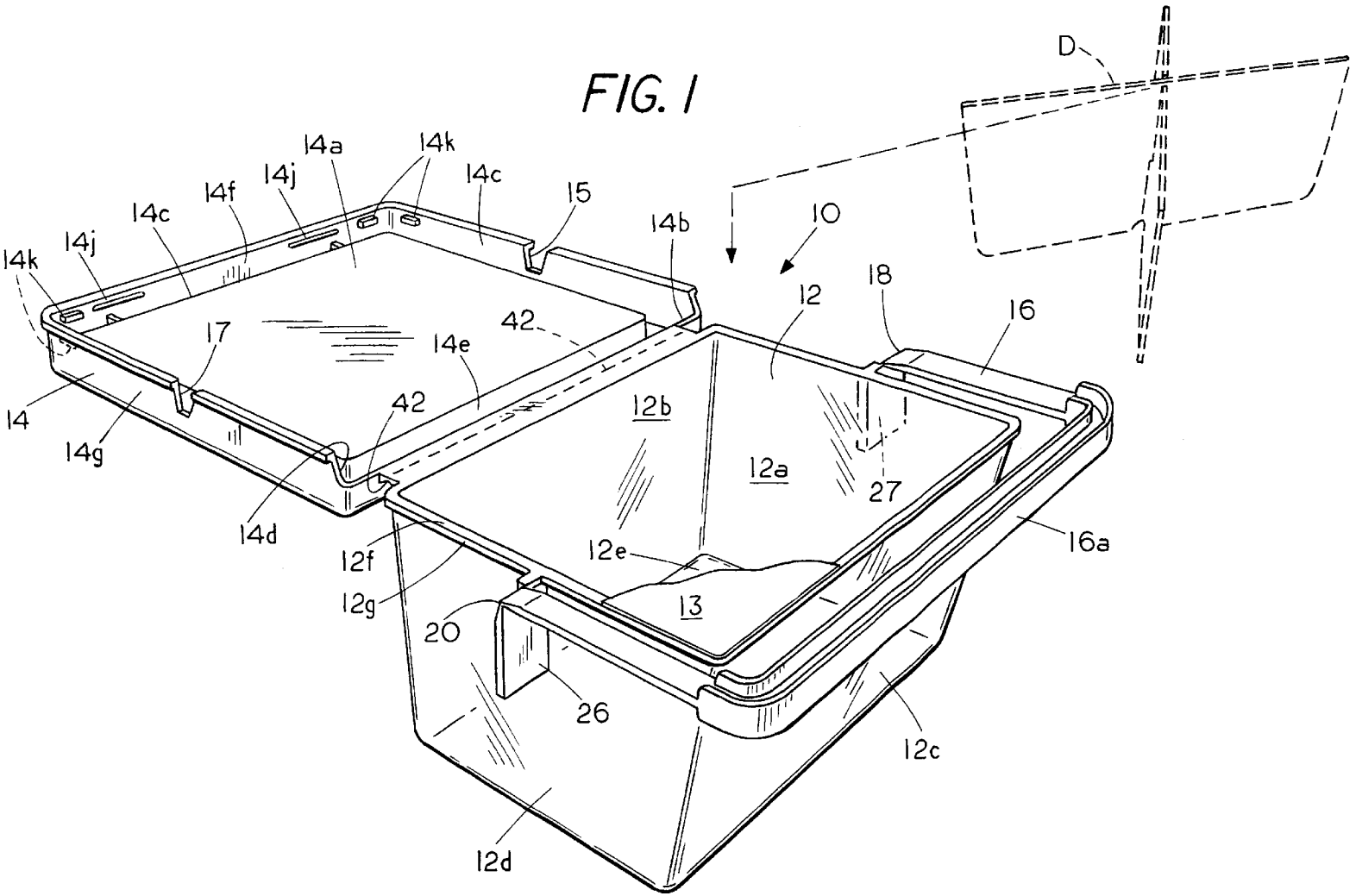
FIG. 1 is a perspective view of the invention showing an optional divider that can be placed in the container body.

FIG. 1 shows, by way of example, a preferred form of plastic container 10 in accordance with the present invention which includes a container body 12 having four generally upright sidewalls 12*a*–12*d* and, a bottom wall 12*e*. The sidewalls terminate in an upper open wide mouth surrounded by a flat rim 12*f* which includes an outwardly projecting lip 12*g*. The rim 12*f* is flat and uninterrupted so as to provide an upper surface that is adapted to receive an optional flexible sealing member 13. The sealing member 13 can be adhesively bonded to the rim 12*f*. The continuous, flat and uninterrupted surface of rim 12*f* enables a hermetic seal e.g. a heat seal to be made between the sealing sheet 13 and the container body 12 for protecting products such as comestibles e.g. refrigerated prepared dishes, puddings, casseroles, snacks or dairy products e.g. yogurt, cream cheese or meat products. After the food has been placed in the container the sealing sheet 13 can be heat sealed e.g. by means of a thermoplastic adhesive to the rim 12*f* conventionally if desired. Prior to being filled, the containers 10 in accordance with the invention can be stacked within one another while in storage. The containers 10 can be formed from any suitable resin such as polyethylene, polystyrene or polypropylene.

Figure 2:
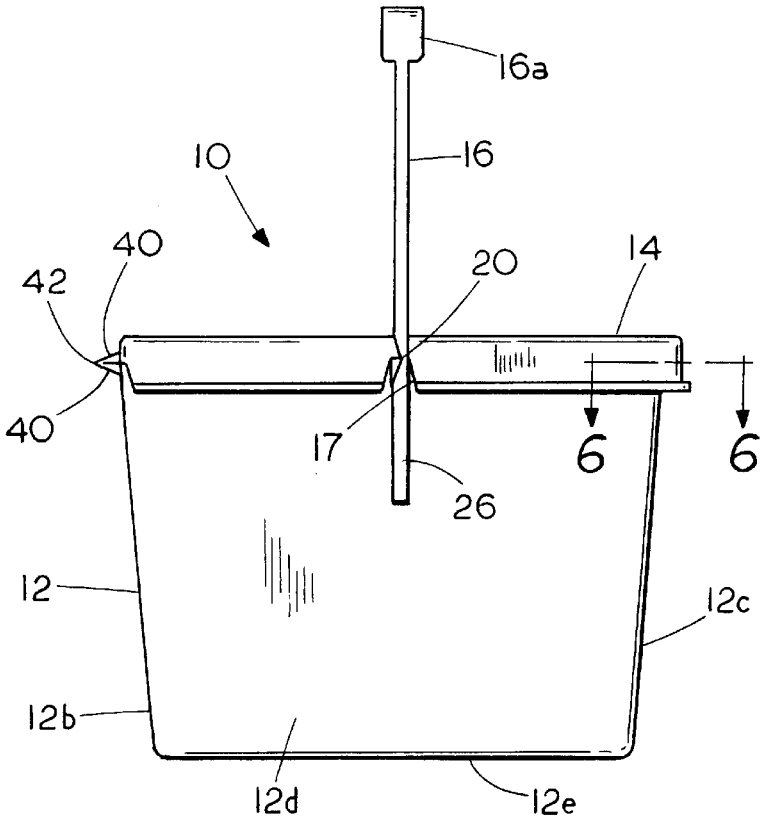
FIG. 2 is an end elevational view of the container with the handle in an upright position and the lid in a closed position.
Figure 6:
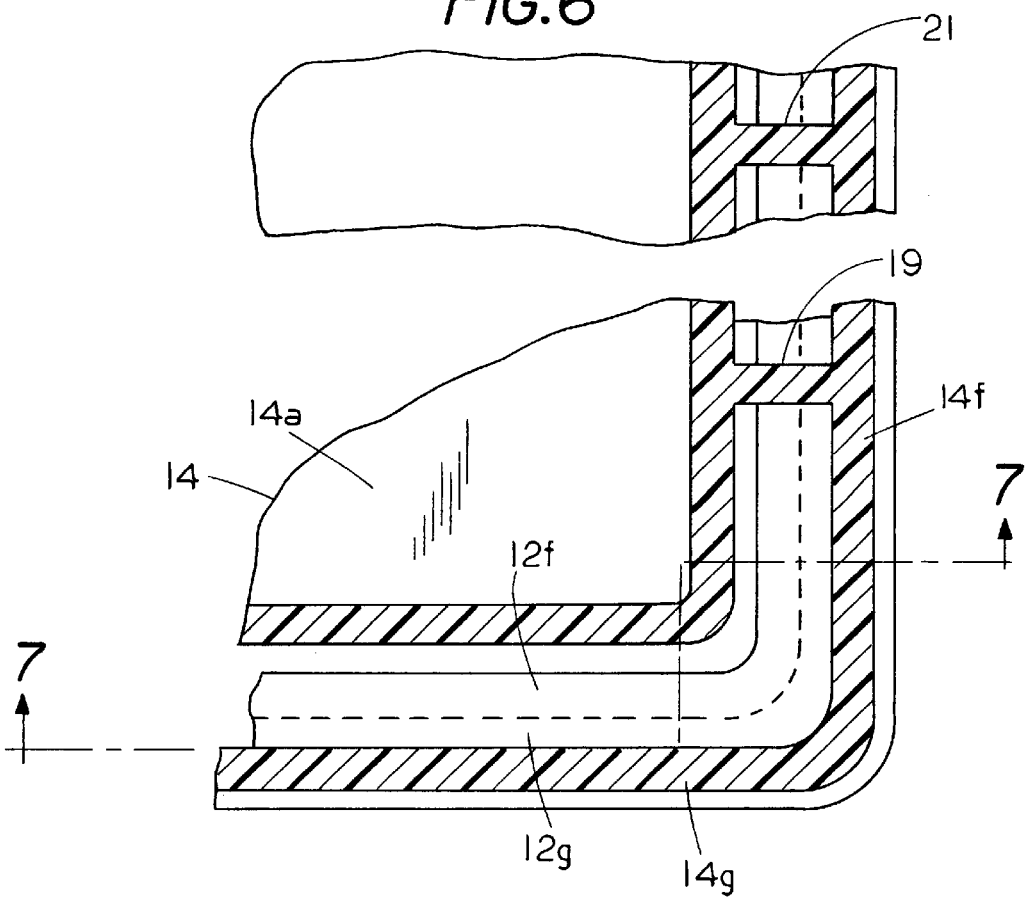
FIG. 6 is a partial horizontal sectional view taken on line 6—6 of FIG. 2 on an enlarged scale.
Figure 7:
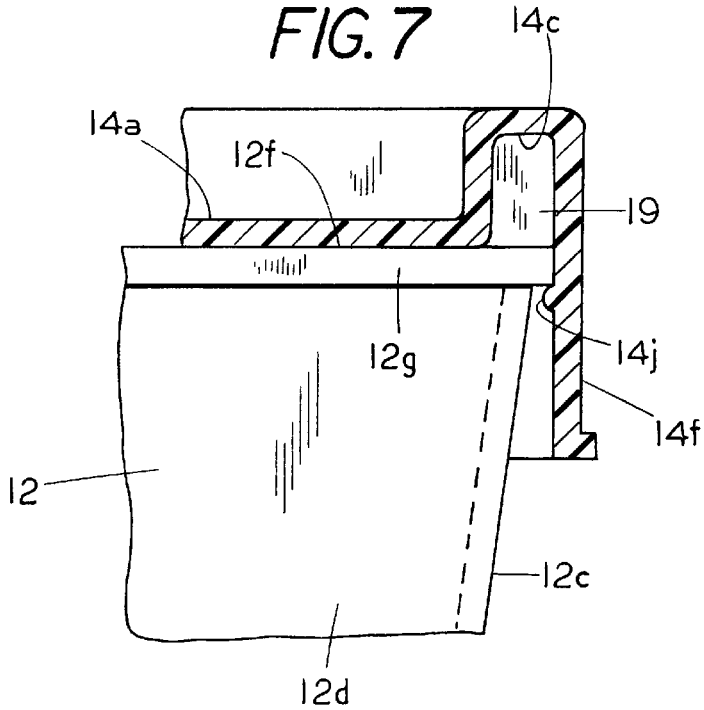
FIG. 7 is a vertical sectional view taken on line 7—7 of FIG. 6.

The cover or lid 14 includes a drop center 14*a* surrounded on four sides by a downwardly facing channel 14*b*, 14*c*, 14*d* and 14*e* (FIG. 1) having an outer wall 14*e* 14*f* 14*g* which encloses the rim 12*f* when the lid is in the closed position (FIG. 2). The walls 14*e* and 14*g* are provided with notches 15 and 17 to accommodate hinge supports to be described below. To hold the lid 14 in the proper closed position, a pair of integral stops 19 and 21 (FIG. 6) are provided in the channel 14*c* which rest on the rim 12*f* when the lid is in the closed position (FIG. 7). On the inside of the wall 14*f* are provided six protrusions 14*j* and 14*k* which snap over the rim 12*g* when the lid is pressed downwardly to the closed position of FIGS. 2, 6 and 7. The drop center 14*a* surrounded by the channel 14*b*, 14*c*, 14*d*, and 14*e* was found highly effective in rigidifying the lid 14. The channel in the lid surrounding the drop center 14*a* also stabilizes the lid on the container body 12 when in the closed position of FIG. 2. The lid can therefore be thought of as self stabilizing. The channel, in addition, acts as a cradle for stacking filled containers. It will also be seen that the lid 14 protects the flexible sealing sheet 13 when the lid is in the closed position.

Molded integrally with the container body 12 is a handle 16 including a central handgrip portion 16 with two parallel legs which terminate in hinges 18 and 20 that are integral with the rest of the container 10.

Figure 8:
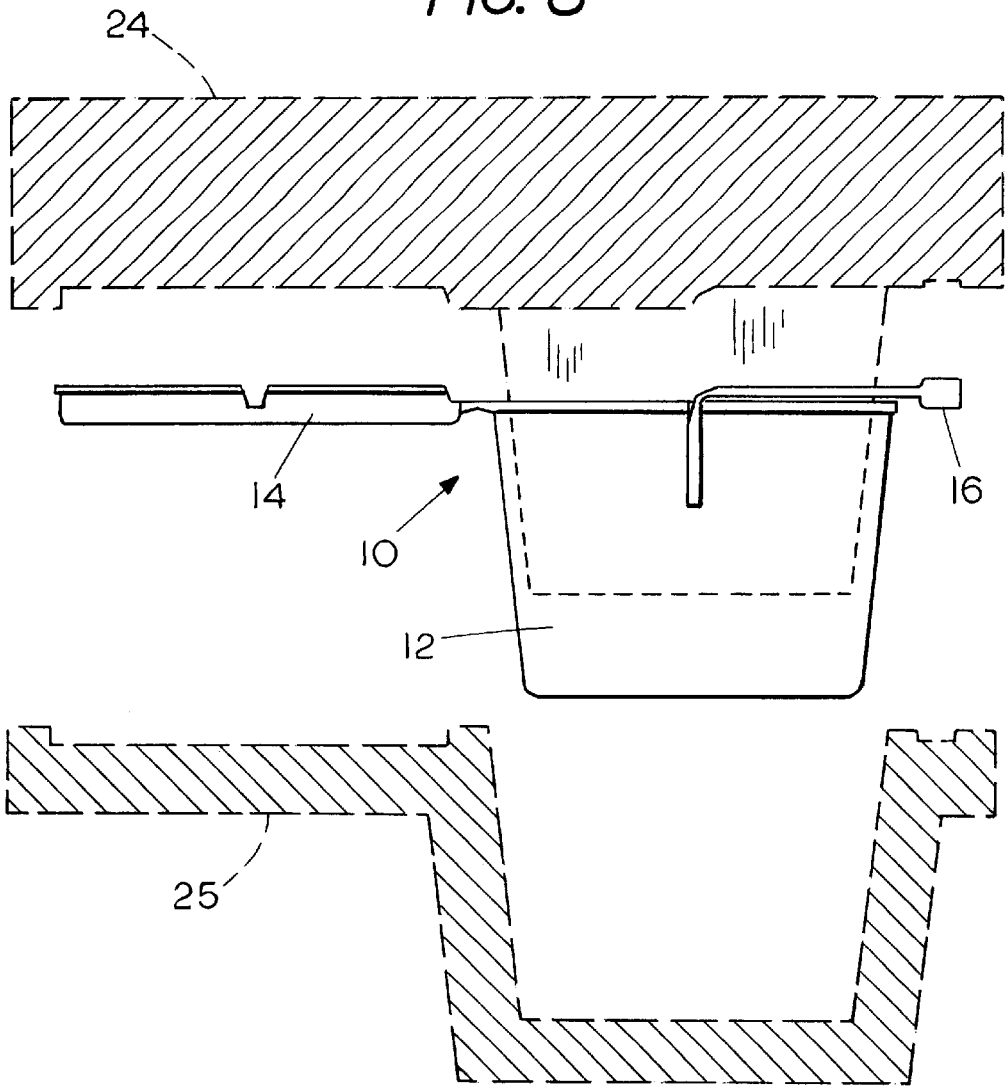
FIG. 8 is a diagrammatic side elevational view of the invention partly in section during the last stage of molding.

Refer now to FIGS. 4 and 5 which illustrate one of the handle hinges 20. Since the other handle hinge 18 and associated structures is similar only one will be described. As shown in FIG. 4 and 5 the leg of handle 16 is beveled at the end to provide a tapered end portion 22 that terminates in a thin hinge portion 20 defined by a relatively thin ligament of plastic resin which is integrally connected between the leg and hinge support 26, the latter being disposed vertically and is integral with the side wall of the container body at 28. A similar hinge support 27 is provided on the opposite side of the container for the hinge 18 as shown in FIG. 1. It will be noted that the upper end 30 of the hinge support 26 and the hinge 20 itself are both aligned with the top surface of the rim 12*f* By positioning both hinges 18 and 20 in alignment with the rim 12*f* it was discovered that a simple two piece mold comprising male and female molding dies 24 and 25 (FIG. 8) could be used to mold the entire container without the requirement for additional mold components. This is possible because of the mold separation that can be achieved by having the female mold half form the lower surface of the rim 12*f* and lip 12*g* as well as the lower surface of the handle 16 while the male die forms the upper surfaces of the same components. The confronting male and female dies separate along a line that corresponds generally to the top of the rim 12*f* and the upper surface of the handle 16 while in the position shown in FIG. 1. It was, found however, that if the hinges 18 and 20 were significantly above or below the rim 12*f*, additional mold parts would be required to enable the dies to separate in a manner that would allow the molded container 10 to be removed. Consequently the invention provides a way of molding a container of the type described with a simple and relatively inexpensively two part mold.

Figure 3:
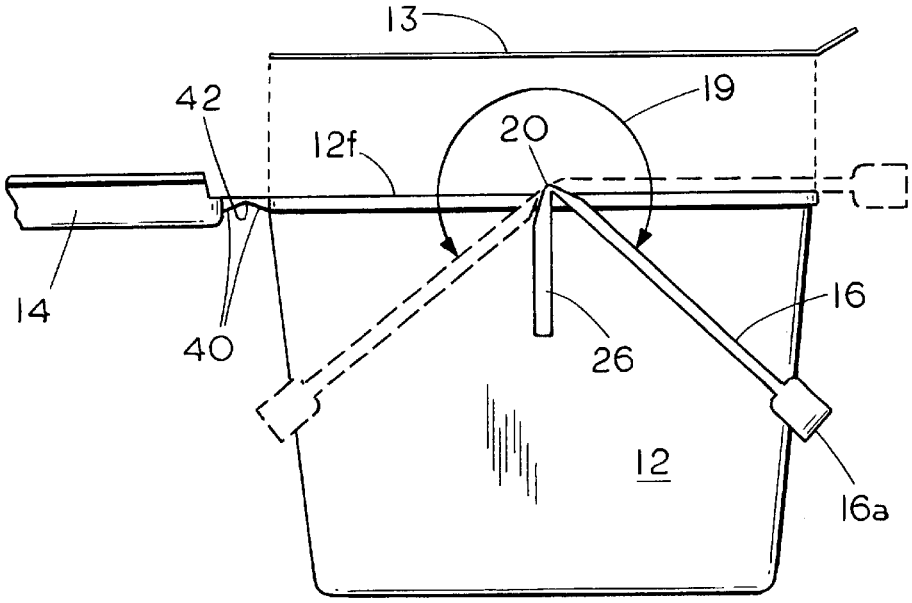
FIG. 3 is an end elevational view of the invention showing the lid in an open position and the handle in alternate positions.

With reference to FIGS. 4 and 5 it will be seen that the hinge support 26 has a beveled sidewall 32 at an upper end thereof to define an upper end portion of reduced thickness proximate the hinge 20. This bevel allows unobstructed pivotal movement of the handle 16 about the hinges 18 and 20 in an arc 19 as shown in FIG. 3 in each direction until the hand grip 16*a* contacts the container body 12 (FIG. 3). By allowing the handle to pivot freely about the pivots 18 and 20 in both directions without anything present in the hinge area 18 and 20 such as abutting walls or surfaces, it was discovered that virtually no stress is placed on the hinges 18 and 20 either during storage or while the container is being carried by the handle. This gives the hinges long life by preventing them from breaking prematurely.

Between the rim 12*f* and the lid 14 is a hinge 42 that extends substantially the entire length of the container. The hinge 42 as clearly shown in FIG. 3 is formed by a pair of upwardly inclined beveled surfaces 40 on a lower surface of the rim 12*f* that converge to form a line of plastic material of a reduced thickness that defines the hinge 42 for the lid 14. It will be noted that the flat upper surface of the rim 12*f* above the beveled surfaces 40 serves to facilitate the attachment of the flexible sealing sheet 13 to the top of the container body 12.

Containers of the present invention are well suited for marketing a variety of foods or other perishables products since a flexible sealing sheet can be readily bonded to the container body 12 to provide a hermetic seal. Moreover, the construction and placement of the hinges 18 and 20 at the same elevation and in alignment with the upper surface of the rim 12*f* permits the container 10 to be molded with a simple two part mold consisting of cooperating male and female mold halves confronting one another. In addition, the provision of a beveled sidewall at the upper end of each of the hinge supports 26 and 27 to define upper portions of reduced thickness proximate the hinges 18 and 20 allow unobstructed pivotal movement of the handle 16 about the hinges in each direction until the hand grip 16*a* contacts the container body as shown in FIG. 3. This prevents the hinges 18 and 20 from being placed under stress thereby preventing breakage, thus prolonging the life of the container. The containers of the invention are useful without the flexible sealing sheet 13 for a variety of different kinds of products including hardware items such as screws, nuts, bolts, shell casings and numerous other hardware items. If more than one kind of product is placed in the container 10 a suitable divider D which can be formed from cardboard or plastic can be placed within the container body 12, if desired (FIG. 1).

Many variations of the invention within the scope of the appended claims will be apparent to those skilled in the art once the principles described herein are read and understood.

What is claimed is:

1. A plastic container of integrally molded one piece construction, said container comprising, a container body having an integral handle and a lid, the container body has side walls terminating in an upwardly facing rim that has an upper surface which is shaped to have a sealing member adhesively bonded thereto, a pair of hinge supports molded integrally with the container body, each hinge support having an upper hinge end positioned in lateral alignment with the rim, the handle has a central hand grip portion and a pair of legs each hinged to one of the hinge supports and molded integrally therewith, a pair of aligned hinges defined by plastic ligaments of reduced thickness that are each positioned at the elevation of the rim and aligned therewith between one of the supports and a leg of the handle, a beveled side wall at the upper end of each of the hinge supports that is thinner at said upper end thereof to define an upper edge of reduced thickness proximate one of said hinges for enabling unobstructed pivotal movement of the handle about the hinges in each direction until the hand grip contacts the container body.

2. The container of claim 1 wherein the rim is uninterrupted to provide a continuous, flat surface and a flexible sealing sheet is bonded thereto.

3. The container of claim 2 wherein the flexible sheet is adhesively bonded to the rim.

4. The container of claim 1 wherein each handle adjacent the hinge support has a beveled surface to provide a narrowing of the handle proceeding in the direction of the hinge.

5. The container of claim 1 wherein a flat upwardly facing rim surface is provided between the container body and the cover and a rim portion below said flat rim surface has a pair of upwardly inclined beveled surfaces adjacent one another that form a thinner rim portion therebetween for defining a lid hinge of reduced thickness such that the flat upper rim surface is adapted facilitate bonding of a flexible sealing sheet thereto.

6. A plastic container of integrally molded one piece construction, said container comprising, a container body having an integral handle and a lid, the container body has side walls terminating in an upwardly facing rim that has an upper surface that allows a sealing member to be adhesively bonded thereto, a pair of hinge supports molded integrally with the container body, each hinge support having an upper hinge end positioned in lateral alignment with the rim, the handle has a central hand grip portion and a pair of legs each hinged to one of the hinge supports and molded integrally therewith, a pair of aligned hinges defined by plastic ligaments of reduced thickness that are each positioned at the elevation of the rim and located between one of the supports and a leg of the handle, the upper end of each of the hinge supports is thinner at said upper end thereof to define an upper edge of reduced thickness proximate one of said hinges for enabling unobstructed pivotal movement of the handle about the hinges in each direction until the hand grip contacts the container body and, a flat upwardly facing rim surface is provided between the container body and the cover and the rim portion below said flat surface has a pair of upwardly inclined adjacent beveled surfaces proceeding toward one another for defining a lid hinge of reduced thickness therebetween and the flat upper surface of the rim above the lid hinge is adapted to facilitate the attachment of a flexible sealing sheet thereto.

7. The container of claim 6 wherein the rim has an uninterrupted upper face for defining a continuous flat surface and a flexible sealing sheet is bonded thereto.

8. The container of claim 7 wherein the sheet is adhesively bonded to the rim.

9. The container of claim 6, wherein the handle is tapered adjacent to each of the hinges to provide a narrowing of the handle proceeding in the direction of the hinge.

10. The container of claim 6 wherein the lid has a drop center surrounded by a channel and the flat upwardly facing rim surface is adjacent a portion of the channel and above said lid hinged.

11. A plastic container of integrally molded one piece construction, said container comprising, a container body having an integral handle and a lid, the container body has side walls terminating in an upwardly facing rim that has an upper surface which is shaped to have a sealing member adhesively bonded thereto, the rim is uninterrupted for defining a continuous flat surface and a flexible sealing sheet is bonded thereto and, a pair of hinge supports molded integrally with the container body, each hinge support having an upper hinge end positioned in lateral alignment with the rim, the handle has a central hand grip portion and a pair of legs each hinged to one of the hinge supports and molded integrally therewith, a pair of aligned hinges defined by plastic ligaments of reduced thickness that are each positioned at the elevation of the rim and are between one of the supports and a leg of the handle, a beveled side wall at the upper end of each of the hinge supports that is thinner at said upper end thereof to define an upper edge of reduced thickness proximate one of said hinges for enabling unobstructed pivotal movement of the handle about the hinges in each direction until the hand grip contacts the container body, a flat upwardly facing rim surface is provided between the container body and the cover and a rim portion below said flat rim surface has a pair of upwardly inclined beveled surfaces that form a thinner rim portion therebetween for defining a lid hinge of reduced thickness such that the flat upper rim surface is adapted to facilitate the attachment of the flexible sealing sheet thereto and each of the handles is tapered adjacent to the hinge to provide a narrowing of the handle preceding in the direction of each hinge.

12. The container of claim 11 wherein the cover has a drop center surrounded by a channel such that the lid is self-stabilizing and the lid hinge is positioned on a side of the lid adjacent to one of the channels.

* * * * *